United States Patent [19]

Althaus

[11] Patent Number: 5,052,895

[45] Date of Patent: Oct. 1, 1991

[54] PRESSURE WAVE MACHINE

[75] Inventor: Rolf Althaus, Mägenwil, Switzerland

[73] Assignee: Asea Brown Boveri Ltd., Baden, Switzerland

[21] Appl. No.: 557,744

[22] Filed: Jul. 26, 1990

[30] Foreign Application Priority Data

Aug. 17, 1989 [CH] Switzerland ..... 3005/89

[51] Int. Cl.[5] ..... F04F 11/02

[52] U.S. Cl. ..... 417/64; 60/39.45

[58] Field of Search ..... 417/64; 60/39.45 A

[56] References Cited

U.S. PATENT DOCUMENTS

| | | | |
|---|---|---|---|
| 2,399,394 | 4/1946 | Seippel | 60/39.45 A |
| 3,234,736 | 2/1966 | Spalding | 60/39.45 A |
| 3,879,937 | 4/1975 | Jenny | 417/64 |
| 4,170,107 | 10/1979 | Hörler | 417/64 |
| 4,232,999 | 11/1980 | Croes et al. | 417/64 |

FOREIGN PATENT DOCUMENTS

| | | | |
|---|---|---|---|
| 641167 | 8/1950 | United Kingdom | 60/39.45 A |

*Primary Examiner*—Leonard E. Smith
*Assistant Examiner*—Michael I. Kocharov
*Attorney, Agent, or Firm*—Burns, Doane, Swecker & Mathis

[57] ABSTRACT

In a pressure wave machine, the ducts of the connecting casings (3, 4) to and from the cells (2) are provided with a curvature running in the axial direction to the opening of the cells (2) and concave in the direction of the axis (5) of the rotor (1). By this means, the same radial pressure gradients as are found in the cells (2) due to the rotation of the rotor (1) are produced in the connecting casings (3, 4). Secondary flows and reverse flows respectively from the cells (2) into the connecting casings (3, 4) or out of them are therefore prevented.

3 Claims, 1 Drawing Sheet

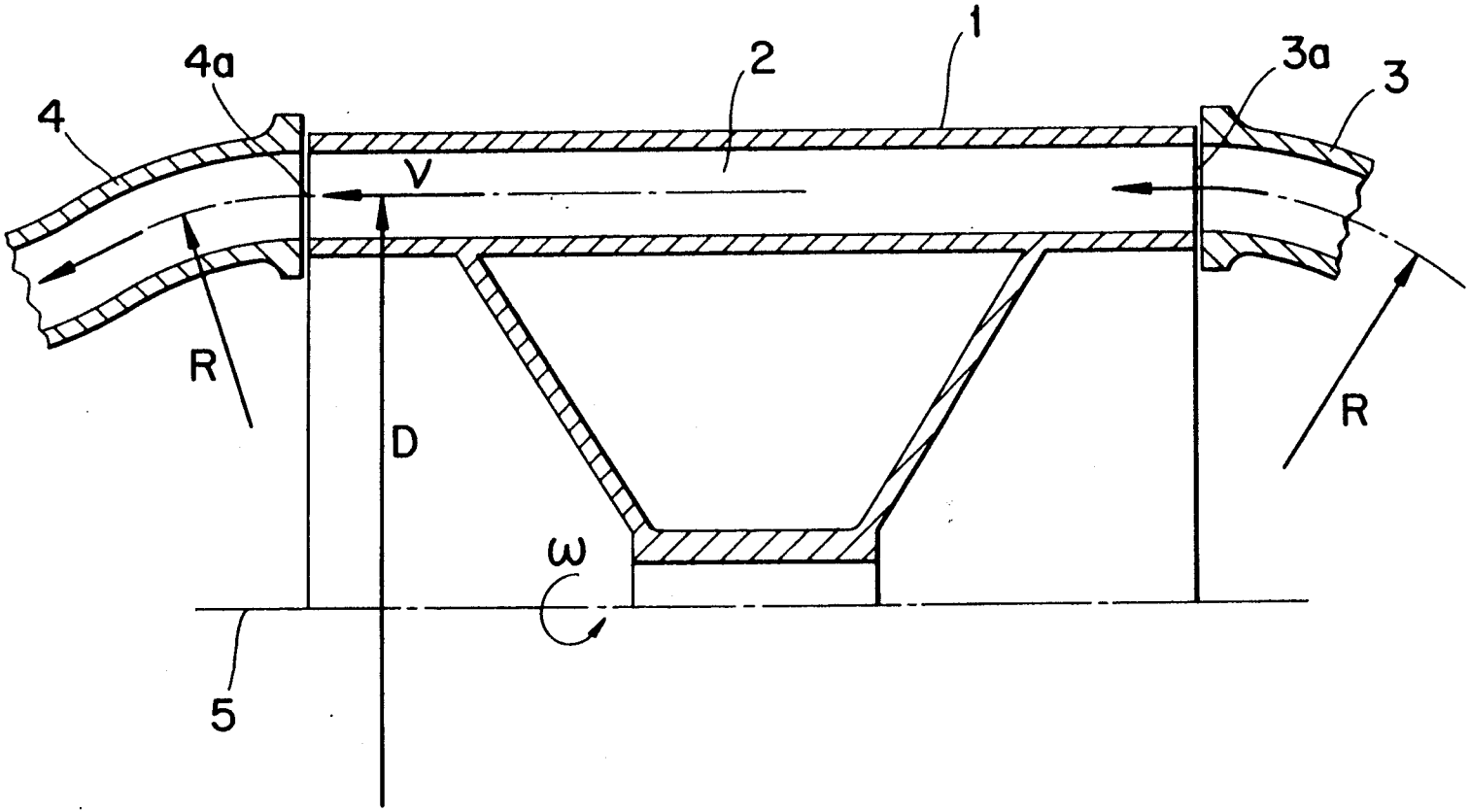
3
3a
R
1
2
V
D
3
4a
R
4
5

PRESSURE WAVE MACHINE

BACKGROUND OF THE INVENTION

1. Field of the Invention

The present invention relates to a pressure wave machine.

2. Discussion of Background

When pressure wave machines are used as the high pressure compressor stage of a gas turbine, precompressed air is further compressed in them in order to generate driving gas for the high pressure turbine part. The further compression of the air then takes place in a rotor whose periphery usually has cells which run parallel to the axis and in which the air comes directly into contact, without a solid separating element, with driving gas branched off from the turbine chamber. In order to control the inlets and outlets of air and gas into or out of the cells, casings with ducts for the supply and/or removal of the two media taking part in the pressure wave process are located at the two end surfaces of the rotor.

If a cell filled with air to be compressed passes in front of a high pressure gas inlet, a pressure wave propagates into the cell and compresses the air. The pressure wave reaches the end of the cell as soon as the latter passes the high pressure air outlet. The air is expelled there and the cell is then completely filled with gas. During further rotation, expansion waves ensure that the gas leaves the cell again and that fresh air is ced, whereupon the compression process is repeated. In contrast to the stationary casings, a radial pressure gradient forms in the cells of the moving rotor because of its rotation. In the vicinity of the ends of the cells and the connecting casings, a balancing flow appears, due to the different radial pressure gradients. This means that the fluid is accelerated at the outside of the rotor when flowing out of the rotor and is retarded at the inside of the rotor, or separation and reverse flow may even occur. When entering the cell, the flow is accelerated on the inside of the rotor and is retarded on the outside. It is generally known that strongly distorted velocity profiles have a direct effect on the efficiency and therefore make it worse. In addition, the blockage at the inlets and outlets greatly reduces the power density of a pressure wave machine.

SUMMARY OF THE INVENTION

Accordingly, one object of this invention is to design the geometry of the inlet and outlet casings, in a pressure wave machine of the type mentioned at the beginning, in such a way that the fluid in the flow ducts of these casings has the same radial pressure gradient imposed upon it as that in the rotor cells.

This object is achieved by the features of the present invention. The essential advantage of the invention may be seen in the fact that an acceleration field is generated by curving the connecting casings in the axial direction in the duct, this acceleration field preventing the above-mentioned balancing processes in the cells in the rotor end/casing region. The danger of separation and reverse flow at this location is therefore countered.

BRIEF DESCRIPTION OF THE DRAWING

A more complete appreciation of the invention and many of the attendant advantages thereof will be readily obtained as the same becomes better understood by reference to the following detailed description when considered in connection with the accompanying drawing, which shows an illustrative embodiment of the invention.

DESCRIPTION OF THE PREFERRED EMBODIMENTS

Referring now to the drawing, wherein all the elements not necessary for direct understanding of the invention have been omitted, the following explanation applies to a pressure wave machine with a counterflow pressure wave process in which the inlet and outlet of the air take place at the two opposite ends of the rotor 1; it also applies in an analogous manner to the process in which the inlet and outlet of the air take place at one and the same end of the rotor. The counterflow process mentioned is the one mainly employed in high pressure compressors for gas turbines.

For ease of understanding, the rotor 1 in the figure is only shown as excerpts and diagrammatically. In this representation, it is also only a single cell 2 and the casings 3 and 4 associated with it which are visible. The outer casing, which encloses the rotor 1 and connects the casings, is not shown. The rotor axis 5 is rotationally asymmetrical. Because of the rotation of the rotor 1, a radial pressure gradient appears in the cells with the pressure increasing towards the outside. In the case of a straight inlet casing, the flow is accelerated at the inside of the cell 2 at the inlet 3*a* into the cell 2 because of the pressure gradients present there and is retarded at the outside of the cell. This means that there is a detrimental, secondary flow in such a configuration. A further detrimental, secondary flow out of the cell 2 occurs when an outlet casing has a straight outlet flow geometry: in the region of the outlet 4*a* from the cell 2, a flow separation occurs which causes a reverse flow from the outlet casing back into the inside of the cell 2, the reverse flow taking place from the position with a higher pressure to the position with a lower pressure.

If, for example, the casings are designed in accordance with the figure, the same centrifugal force on the flow is generated in the curves as then forms in the cell 2: the fluid in the curved inlet casing 3 has the same pressure gradients at the inlet 3*a* into the cell 2 as it finds there, i.e. radial pressure gradients with the pressure increasing towards the outside so that a secondary flow can no longer occur. The same effects are generated in the curved outlet casing 4. It may therefore be stated that curving the connecting casings (inlet casing 3, outlet casing 4) in the axial direction in each duct of the connecting casings generates an acceleration field which prevents the balancing processes mentioned in the region of the inlet 3*a* and outlet 4*a* into or out of the cell 2.

This achieves the effect that the cell 2 is always cleanly filled with fluid and can empty itself and this has, in particular, a positive effect on the power density of the pressure wave machine.

The optimum radius of curvature R is fixed by three variables:

by the flow velocity V of the fluid;

by the average diameter D of the rotor 1;

by the angular velocity W of the rotor 1.

The radius of curvature R at which the centrifugal force occurring there corresponds to that in the cell 2 is determined from the following function:

$$R = \frac{2 \cdot V^2}{D \cdot W^2}$$

The length of the curvature of the casings 3, 4 is preferably three cell hydraulic diameters upstream from the inlet opening 3*a* and downstream from the outlet opening 4*a*. This region ensures that secondary flows or balancing processes occurring further up or down will, in any event, no longer condition the flow in the region of the inlet 3*a* into the cell 2 or of the outlet 4*a* out of the cell 2. This length of curvature must, of course, take account of the geometrical features of the connecting casings. After the curvature length mentioned, a diffuser follows downstream of the outlet opening 4*a* in order to provide a gentle transition of the flow into the following passage. If, for design reasons, no curvature is possible at the outlet 4*a*, help can be provided by the insertion of a diffuser.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. Pressure wave machine, consisting essentially of a rotor (1) with cells (2) directed parallel to the rotor axis (5) and evenly distributed about the periphery of the rotor, which cells are intended, in operation, to accept two gaseous media for the purpose of compressing the first medium by compression waves from the second medium, and of stationary connecting casings (3, 4) for guiding the media, wherein the ducts of the connecting casings (3, 4) upstream of the inlet opening (3*a*) of the cell (2) and downstream of the outlet opening (4*a*) of the cell (2) describe a curvature running in the axial direction to the opening of the cell (2) and concave in the direction of the rotor axis (5), the radius of curvature being given by the function $$R = \frac{2 \cdot V^2}{D \cdot W^2}$$

where V is the flow velocity of the medium, D is the average rotor diameter and W is the angular velocity of the rotor (1).

2. Pressure wave machine according to claim 1, wherein the length of the curvature of the connecting casings (3, 4) upstream from the inlet opening (3*a*) and downstream from the outlet opening (4*a*) respectively is three times the hydraulic diameter of the cell (2).

3. Pressure wave machine according to claim 2, wherein a diffuser is connected downstream of the curvature of the outlet opening (4*a*).

* * * * *